US008424542B1

(12) United States Patent
Han

(10) Patent No.: US 8,424,542 B1
(45) Date of Patent: Apr. 23, 2013

(54) COMBINED TRAY AND APPLICATOR FOR HOLDING AND FACILITATING APPLICATION OF FALSE EYELASHES

(76) Inventor: Yougho Han, Woodbury, NY (US)

( * ) Notice: Subject to any disclaimer, the term of this patent is extended or adjusted under 35 U.S.C. 154(b) by 0 days.

(21) Appl. No.: 13/329,957

(22) Filed: Dec. 19, 2011

(51) Int. Cl.

| | |
|---|---|
| ***A45D 40/30*** | (2006.01) |
| ***A45D 40/26*** | (2006.01) |
| ***A45D 7/02*** | (2006.01) |
| ***A45D 40/00*** | (2006.01) |
| ***A45D 40/18*** | (2006.01) |
| ***B65D 71/00*** | (2006.01) |
| ***B65D 69/00*** | (2006.01) |
| ***B65D 6/04*** | (2006.01) |
| ***B65D 1/34*** | (2006.01) |

(52) U.S. Cl.
USPC ..... 132/216; 132/212; 132/218; 132/286; 206/581; 206/565

(58) Field of Classification Search ..... 132/216, 132/333, 201, 207, 212, 213, 217, 218, 105, 132/53, 54, 56, 319, 320, 286, 314, 317, 132/73, 285, 287, 294; 206/823, 581, 194, 206/229, 560, 562, 565, 564, 456, 5.1, 757, 206/460; 211/126.1, 89.01, 88.01; 434/94; 446/393; 312/122; 220/676, 495.05
See application file for complete search history.

(56) References Cited

U.S. PATENT DOCUMENTS

| | | | | |
|---|---|---|---|---|
| 1,810,566 | A * | 6/1931 | Keney | 446/394 |
| 2,761,558 | A * | 9/1956 | McLean, Jr. | 206/456 |
| 2,835,259 | A * | 5/1958 | Goodman | 132/53 |
| 3,315,689 | A * | 4/1967 | Mehron | 132/317 |
| 3,333,593 | A * | 8/1967 | McGivern | 132/217 |
| 3,491,775 | A * | 1/1970 | Aylott | 132/313 |
| 3,516,423 | A | 6/1970 | Seidler | |
| 3,517,673 | A * | 6/1970 | Kim | 132/214 |
| 3,568,686 | A * | 3/1971 | Navrozides | 132/217 |
| 3,645,281 | A * | 2/1972 | Seidler | 132/333 |
| D223,787 | S | 6/1972 | Seidler | |
| 3,722,519 | A * | 3/1973 | Epstein | 132/216 |
| 3,880,175 | A | 4/1975 | Hosokawa | |
| 3,935,872 | A * | 2/1976 | Aylott | 132/216 |
| 4,018,336 | A * | 4/1977 | Aylott | 206/460 |
| 4,425,997 | A * | 1/1984 | Grant | 206/84 |
| 4,944,402 | A * | 7/1990 | Wu | 206/581 |
| 5,337,897 | A * | 8/1994 | Yablans | 206/581 |
| 5,358,692 | A * | 10/1994 | Reynolds | 422/536 |
| 5,467,868 | A * | 11/1995 | Abrams et al. | 206/5.1 |
| 5,547,529 | A | 8/1996 | Woolf | |
| 5,697,495 | A * | 12/1997 | Abrams et al. | 206/5.1 |
| 5,813,420 | A * | 9/1998 | Sussman | 132/294 |
| 5,931,169 | A * | 8/1999 | Kervoalen | 132/294 |

(Continued)

*Primary Examiner* — Vanitha Elgart
(74) *Attorney, Agent, or Firm* — Richard L. Miller

(57) ABSTRACT

An integral cosmetic eye-enhancer and applier facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer. A pair of applicator trays are replaceably contained within a storage container. A pair of false eyelashes are releasibly attached to corresponding working ends of the pair of applicator trays, respectively. The other corresponding ends of the pair of applicator trays are held by the fingertips of the user generally horizontally so as to have to bend the wrist of the user but not have to squeeze the other corresponding ends of the pair of applicator trays by the fingertips of the user when donning the pair of false eyelashes.

19 Claims, 8 Drawing Sheets

U.S. PATENT DOCUMENTS

| | | | | |
|---|---|---|---|---|
| 6,029,674 | A | 2/2000 | Han | |
| 6,308,716 | B1 | 10/2001 | Han | |
| 7,222,629 | B1 | 5/2007 | Han | |
| 8,061,367 | B2 * | 11/2011 | Rabe et al. | 132/216 |
| 2005/0166939 | A1 | 8/2005 | Stroud | |
| 2008/0190443 | A1 * | 8/2008 | Ubertifoppa | 132/294 |
| 2009/0044827 | A1 | 2/2009 | Zilber et al. | |
| 2010/0043816 | A1 * | 2/2010 | Dix | 132/201 |
| 2012/0000957 | A1 * | 1/2012 | Martinez | 225/57 |

* cited by examiner

COMBINED TRAY AND APPLICATOR FOR HOLDING AND FACILITATING APPLICATION OF FALSE EYELASHES

1. BACKGROUND OF THE INVENTION

A. Field of the Invention

The embodiments of the present invention relate to a cosmetic eye-enhancer, and more particularly, the embodiments of the present invention relate to an integral cosmetic eye-enhancer and applier for facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer.

B. Description of the Prior Art

Having the right cosmetic tool is essential for applying makeup correctly and accurately.

Today there are a number of cosmetic tools in the market, each with its own specific purpose. In some cases people have utilized one cosmetic tool to do more than one job. For example, individuals who apply and/or wear false eyelashes may have used narrow-tipped tweezers to help in the application of the false eyelash. These narrow-tipped tweezers are generally designed to remove fine hairs, not to hold lashes. The narrow-tipped tweezers, if used to hold false eyelashes, will only hold just a few lashes, and will not provide much control over the false eyelash during application.

A number of cosmetic tools have been developed to help apply false eyelashes, while other tools having different intended purposes have been substituted to assist in the process of putting on eyelashes.

Numerous innovations for false eyelashes, their applicators, and their adhesives have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach an integral cosmetic eye-enhancer and applier for facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer.

(1) U.S. Pat. No. 3,516,423 to Seidler

U.S. Pat. No. 3,516,423—issued to Seidler on Jun. 23, 1970 in US class 132 and subclass 88.7—teaches a cosmetic article applicator especially suited for applying false eyelashes. The applicator includes a support surface to which the cosmetic article is temporarily adhered for manipulation of the article into adhering engagement with the skin of the wearer. The surface to which the cosmetic article is temporarily adhered includes an adhering medium that is, preferably, a silicone base adhesive that is washable to remove contaminants and renew the tackiness of the adhesive. In applying the cosmetic article to the skin, a surgical tape is utilized, which is supported on a compressible surface in order that the tape is caused to conform to the cosmetic article on the support surface.

(2) U.S. Pat. No. Des. 223,787 to Seidler

U.S. Pat. No. Des. 223,787—issued to Seidler on Jun. 6, 1972 in US class D3 and subclass 99—teaches the ornamental design for a false eyelash holder.

(3) U.S. Pat. No. 3,880,175 to Hosokawa

U.S. Pat. No. 3,880,175—issued to Hosokawa on Apr. 29, 1975 in US class 132 and subclass 53—teaches a false eyelash structure including a number of hair units mounted on a supporting yarn and bonded to a plastic film that is mountable onto the upper eyelid of a human being. The film may be colored to function as eye shadow.

(4) U.S. Pat. No. 5,547,529 to Woolf

U.S. Pat. No. 5,547,529—issued to Woolf on Aug. 20, 1996 in US class 156 and subclass 61—teaches a false eyelash system for producing unknotted clusters of false eyelashes from long fibers. A plurality of long fibers are knotted around a main string with a preliminary knot. The long fibers are trimmed a distance away from the main string, which corresponds to a desired eyelash length. Cement is applied to the preliminary knot and a discernible distance therefrom to form a cement clot. The preliminary knot is removed by cutting through the cement clot to form unknotted clusters of false eyelashes.

(5) U.S. Pat. No. 6,029,674 to Han

U.S. Pat. No. 6,029,674—issued to Han on Feb. 29, 2000 in US class 132 and subclass 216—teaches a device for attaching a false eyelash, with an original adhesive thereon, to an eyelid when the original adhesive thereon has lost its adhesion. The device includes a core and an adhesive coating that surrounds the core so as to form an attaching element. The adhesive coating attaches the core along the false eyelash and also allows the false eyelash to then be attached to the eyelid. The device further includes a primary substrate, a secondary substrate disposed on the primary substrate and has a plurality of the attaching elements spaced longitudinally therealong and held releasibly thereon by the adhesive coating of each attaching element, a plurality of release sheet covers, each of which covers and protects an associated attaching element prior to use, and is held releasibly thereon by the adhesive coating of the associated attaching element, and at least one pair of false eyelashes disposed on the primary substrate.

(6) U.S. Pat. No. 6,308,716 to Han

U.S. Pat. No. 6,308,716—issued to Han on Oct. 30, 2001 in US class 132 and subclass 53—teaches an improved core for an adhesive device for attaching a false eyelash to an eyelid. The adhesive device is of a type that has a core, an adhesive coating that surrounds the core so as to form an attaching element, a primary substrate that is a card and has a face with an upper area that has a display throughbore therethrough for a hanging display and a lower area, a secondary substrate that is disposed on the upper area of the primary substrate, below the display throughbore therethrough, and a plurality of release sheet covers that are individual and separate from each other. The improvement includes the core being a plurality of synthetic fibers laid side by side and not twisted, braided, interwoven, intertwined, entwined, or interlaced with each other. Each synthetic fiber is thin, smooth, and does not absorb the adhesive coating so as to remain soft and pliable.

(7) United States Patent Application Publication Number 2005/0166939 to Stroud

United States Patent Application Publication Number 2005/0166939—published to Stroud on Aug. 4, 2005 in US class 132 and subclass 216—teaches a false eyelash applicator that is a generally U-shaped hand tool having two arms joined together by a middle portion. The arms are mirror images of each other and are parallel to the other. Each arm has an end, a neck section, and a handle section. The middle portion is flanked on each side by the handle sections of each arm. The ends have a width and a slightly concave edge that serves to hold the false eyelash. The width of the applicator's ends permits the applicator to grasp up to about three-fourths of the false eyelash, and not just a few lashes, at one time for more accuracy. The applicator is constructed of flexible and resilient material to permit the applicator to be folded into its generally U-shaped configuration and be manipulated.

(8) U.S. Pat. No. 7,222,629 to Han

U.S. Pat. No. 7,222,629—issued to Han on May 29, 2007 in US class 132 and subclass 216—teaches an apparatus for securing an eyelash holder platform to a back of a beautician's hand, which has a finger ring, which is removably attachable to an eyelash holder platform, and which is to be worn on a beautician's finger so as to maintain the location of the platform in the proximity of the back of the beautician's hand.

(9) United States Patent Application Publication Number 2009/0044827 to Zilber et al.

United States Patent Application Publication Number 2009/0044827 published to Zilber et al. on Feb. 19, 2009 in US class 132 and subclass 297—teaches a cosmetics container system including a first compact that includes apparatus for releasibly attaching the first compact to a side or a bottom of another first compact or to a compact of a smaller size.

It is apparent that numerous innovations for false eyelashes, their applicators, and their adhesives have been provided in the prior art, which are adapted to be used. Furthermore, even though these innovations may be suitable for the specific individual purposes to which they address, nevertheless, they would not be suitable for the purposes of the embodiments of the present invention as heretofore described, namely, an integral cosmetic eye-enhancer and applier for facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer.

2. SUMMARY OF THE INVENTION

Thus, an object of the embodiments of the present invention is to provide an integral cosmetic eye-enhancer and applier for facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer, which avoids the disadvantages of the prior art.

Briefly stated, another object of the embodiments of the present invention is to provide an integral cosmetic eye-enhancer and applier facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer. A pair of applicator trays are replaceably contained within a storage container. A pair of false eyelashes are releasibly attached to corresponding working ends of the pair of applicator trays, respectively. The other corresponding ends of the pair of applicator trays are held by the fingertips of the user generally horizontally so as to have to bend the wrist of the user but not have to squeeze the other corresponding ends of the pair of applicator trays by the fingertips of the user when donning the pair of false eyelashes.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows:

FIG. 1 is a diagrammatic perspective view of an integral cosmetic eye-enhancer and applier of the embodiments of the present invention facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer;

Figure 11:
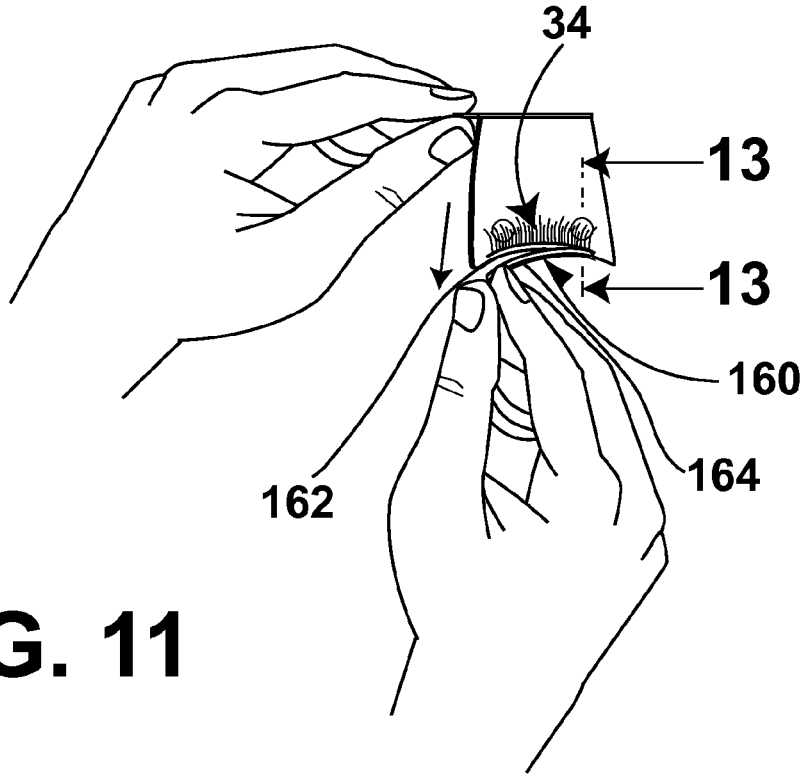
FIG. 11 is a diagrammatic perspective view of a first embodiment of an affixing apparatus of the integral cosmetic eye-enhancer and applier of the embodiments of the present invention.
Figure 12:
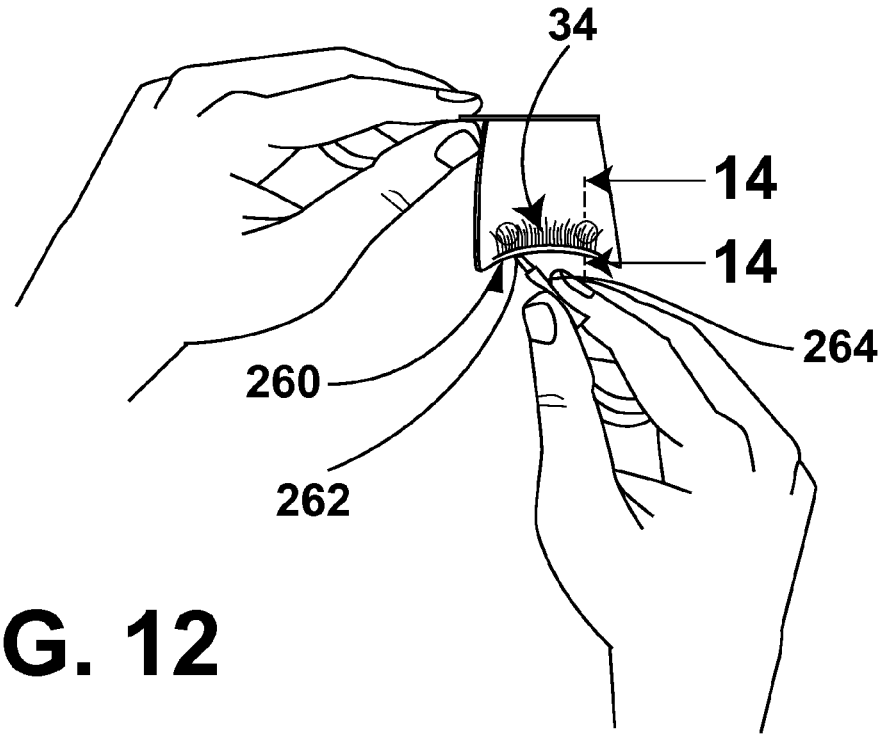
FIG. 12 is a diagrammatic perspective view of a second embodiment of an affixing apparatus of the integral cosmetic eye-enhancer and applier of the embodiments of the present invention.
Figure 13:
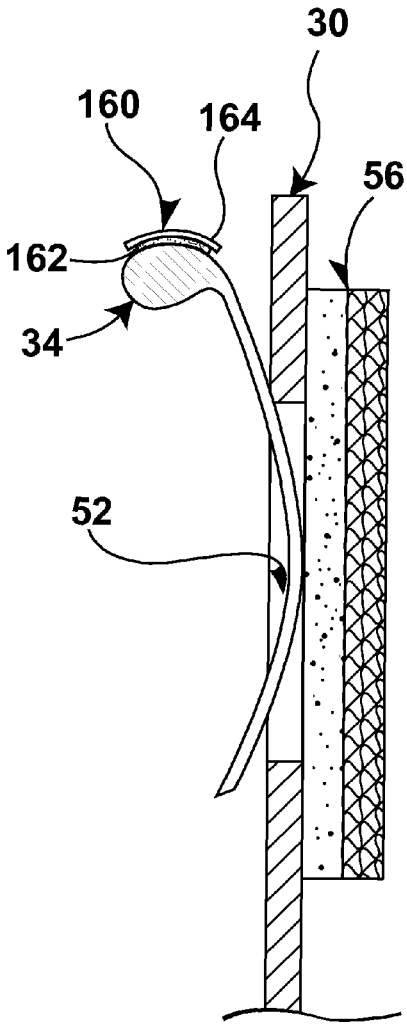
Figure 14:
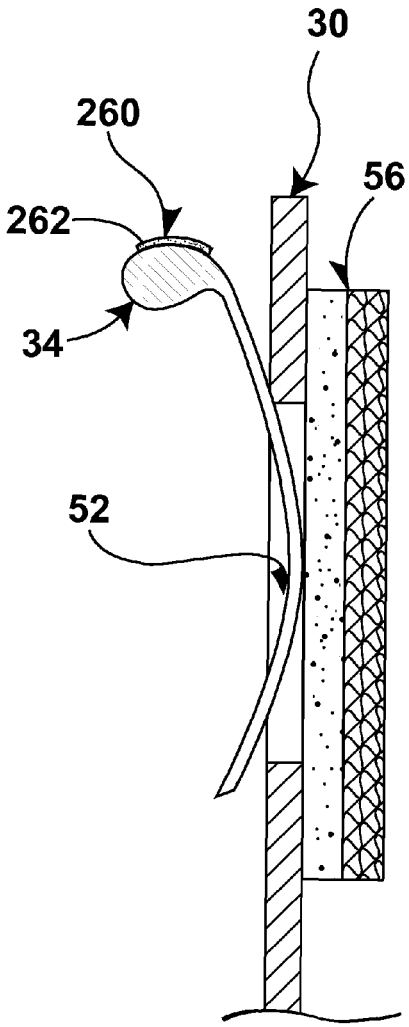

FIG. 13 is an enlarged diagrammatic cross sectional view taken along LINE 13-13 in FIG. 11 of the affixing apparatus embodiment shown in FIG. 11 but in a storage container of the integral cosmetic eye-enhancer and applier of the embodiments of the present invention; and FIG. 14 is an enlarged diagrammatic cross sectional view taken along LINE 14-14 in FIG. 12 of the affixing apparatus embodiment shown in FIG. 12 but in a storage container of the integral cosmetic eye-enhancer and applier of the embodiments of the present invention.

4. LIST OF REFERENCE NUMERALS UTILIZED IN THE FIGURES OF THE DRAWING

A. Introduction.

20 integral cosmetic eye-enhancer and applier of embodiments of present invention for facilitating donning of cosmetic eye-enhancer 22 by holding applier 24 by fingertips 26 of user 28 generally horizontally so as to have to bend wrist of user but not have to squeeze applier 24 by fingertips 26 of user 28 when donning cosmetic eye-enhancer 22

22 cosmetic eye-enhancer

24 applier

26 fingertips of user 28

28 user

B. Configuration of Integral Cosmetic Eye-Enhancer and Applier 20.

30 storage container

32 pair of applicator trays

34 pair of false eyelashes

36 corresponding working ends of pair of applicator trays 32, respectively

38 other corresponding ends of pair of applicator trays, respectively, for holding by fingertips 26 of user 28 generally horizontally so as to have to bend wrist of user 28 but not have to squeeze other corresponding ends 38 of pair of applicator trays 32, respectively, by fingertips 26 of user 28 when donning pair of false eyelashes 34 so as to facilitate donning of pair of false eyelashes 34

(1) Specific Configuration of Storage Container 30.

40 top of storage container 30

42 front wall of storage container 30

44 recess of top 40 of storage container 30

46 pair of through openings of front wall 42 of storage container 30

48 pair of dovetailed mortises of pair of through openings 46 of front wall 42 of storage container 30, respectively (2) Specific Configuration of Pair of Applicator Trays 32 and Pair of False Eyelashes 34.

50 pair of generally normally bent down tabs of other corresponding ends 38 of pair of applicator trays 32, respectively

52 two pair of through bores of pair of applicator trays 32, respectively

54 pair of lowermost surfaces of pair of applicator trays 32, respectively

56 pair of tape strips of pair of applicator trays 32, respectively

58 pair of uppermost surfaces of pair of applicator trays 32, respectively

60 affixing apparatus ofpair of false eyelashes 34 for releasibly affixing pair of false eyelashes 34 to eyelashes of user 28

(a) Specific Configuration of First Embodiment of Affixing Apparatus 160.

160 affixing apparatus

162 adhesives of affixing apparatus 160

164 release sheets of affixing apparatus 160

(b) Specific Configuration of Second Embodiment of Affixing Apparatus 260.

260 affixing apparatus

262 adhesives of affixing apparatus 260

264 tube of adhesives 262 of affixing apparatus 260

5. DETAILED DESCRIPTION OF THE PREFERRED EMBODIMENTS

A. Introduction.

Figure 1:
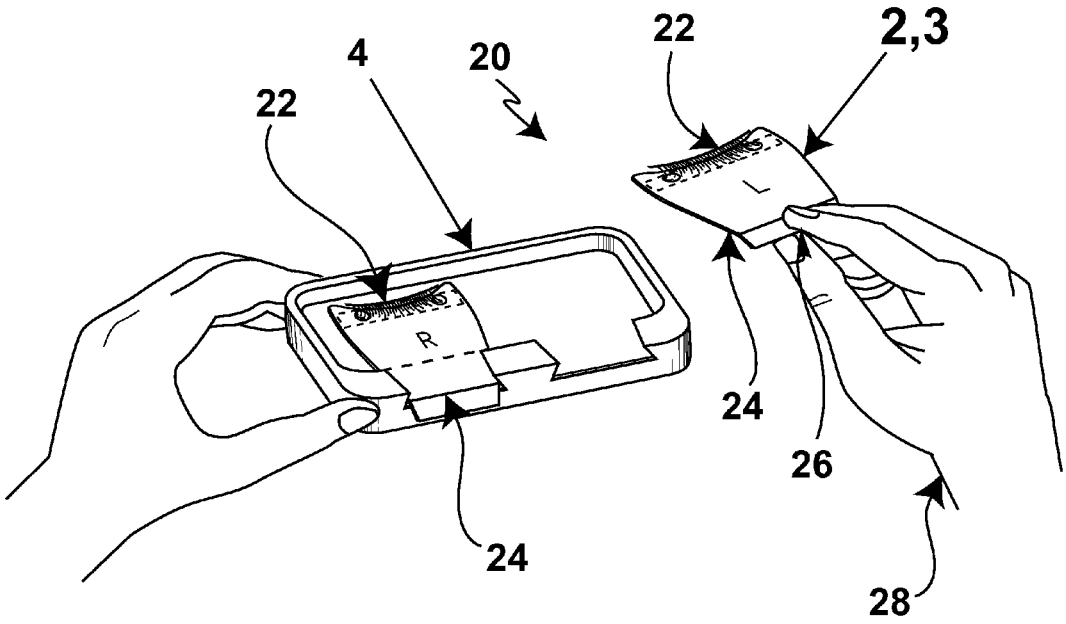
Figure 2:
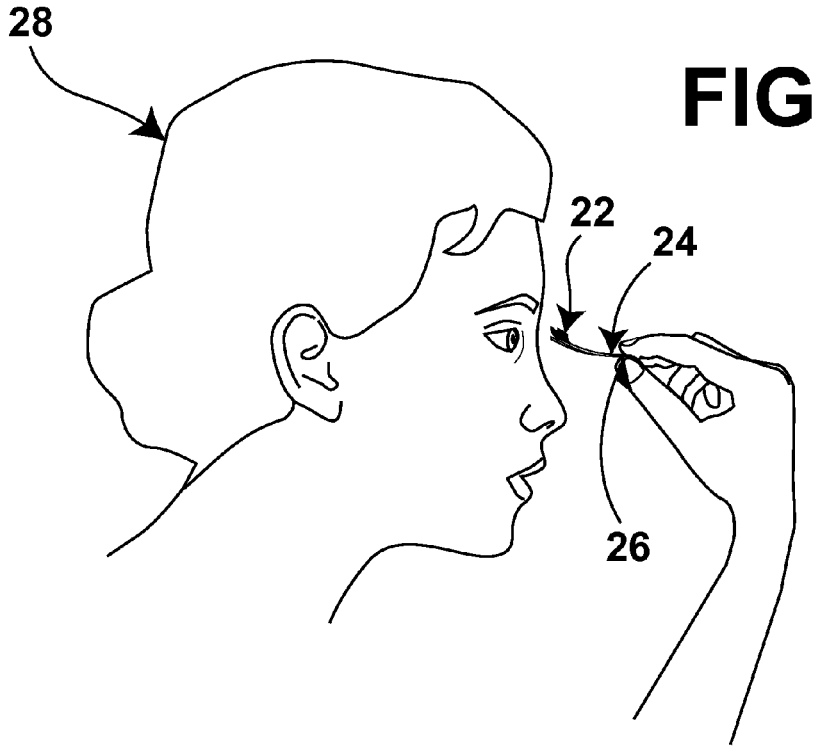
FIG. 2 is a diagrammatic side elevational view of the integral cosmetic eye, enhancer and applier of the embodiments of the present invention identified by ARROW 2 in FIG. 1 being donned by holding the applier by the fingertips of a user generally horizontally so as to have to bend the wrist of the user but not have to squeeze the applier by the fingertips of the user.
Figure 3:
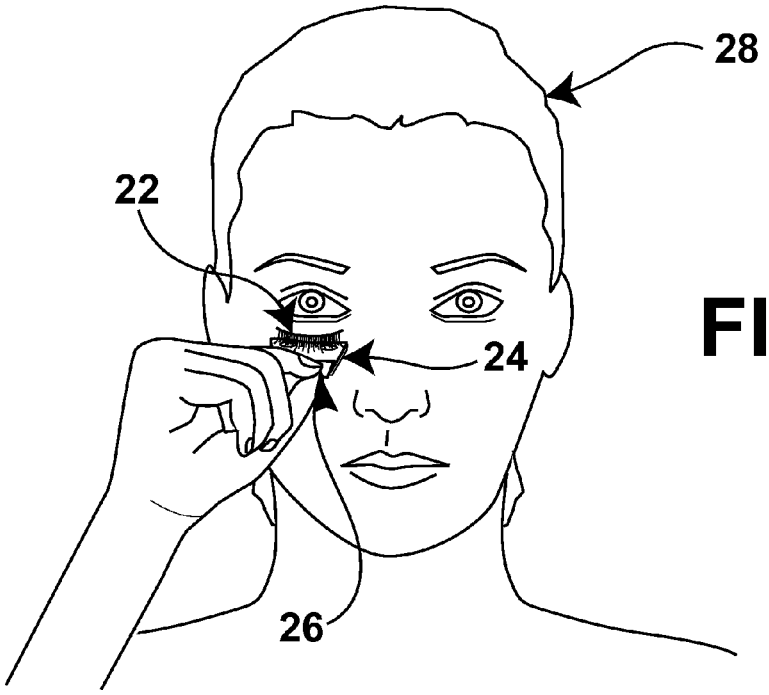
FIG. 3 is a diagrammatic front elevational view of the integral cosmetic eye-enhancer and applier of the embodiments of the present invention identified by ARROW 3 in FIG. 1 being donned by holding the applier by the fingertips of a user generally horizontally so as to have to bend the wrist of the user but not have to squeeze the applier by the fingertips of the user.

Referring now to the figures, in which like numerals indicate like parts, and particularly to FIGS. 1-3, which are, respectively, a diagrammatic perspective view of an integral cosmetic eye-enhancer and applier of the embodiments of the present invention facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer, a diagrammatic side elevational view of the integral cosmetic eye-enhancer and applier of the embodiments of the present invention identified by ARROW 2 in FIG. 1 being donned by holding the applier by the fingertips of a user generally horizontally so as to have to bend the wrist of the user but not have to squeeze the applier by the fingertips of the user, and a diagrammatic front elevational view of the integral cosmetic eye-enhancer and applier of the embodiments of the present invention identified by ARROW 3 in FIG. 1 being donned by holding the applier by the fingertips of a user generally horizontally so as to have to bend the wrist of the user but not have to squeeze the applier by the fingertips of the user, the integral cosmetic eye-enhancer and applier of the embodiments of the present invention is shown generally at 20 for facilitating donning of the cosmetic eye-enhancer 22 by holding the applier 24 by the fingertips 26 of a user 28 generally horizontally so as to have to bend the wrist of the user but not have to squeeze the applier 24 by the fingertips 26 of the user 28 when donning the cosmetic eye-enhancer 22.

B. Configuration of the Integral Cosmetic Eye-Enhancer and Applier 20.

Figure 4:
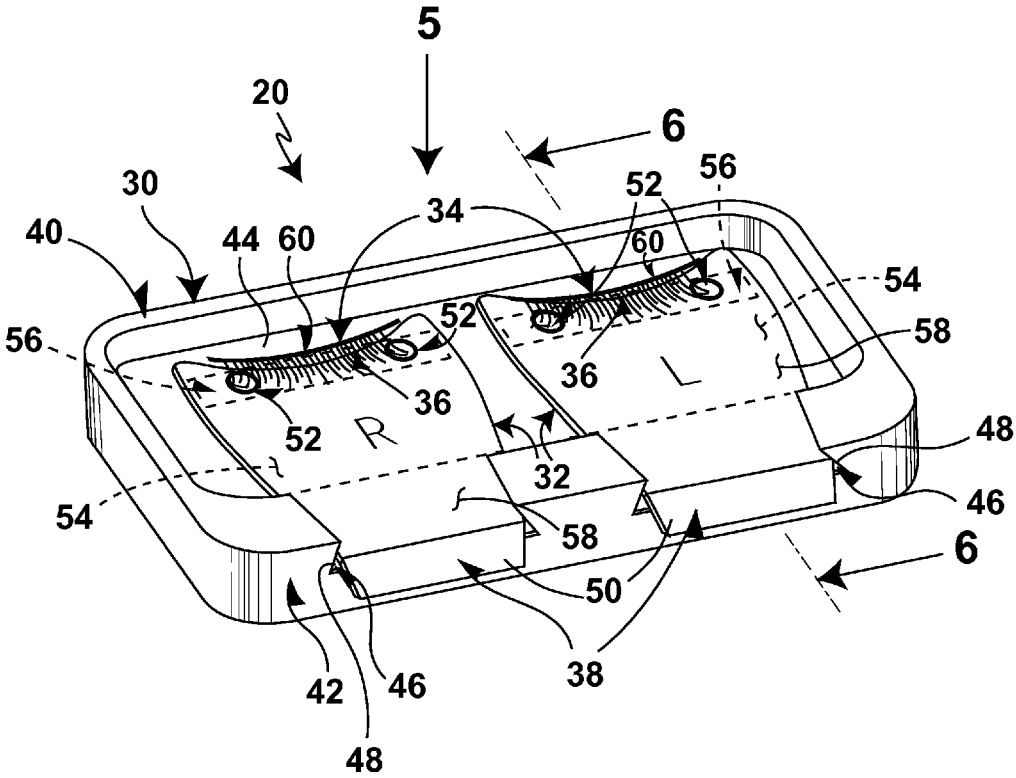
FIG. 4 is an enlarged diagrammatic perspective view of the integral cosmetic eye-enhancer and applier of the embodiments of the present invention identified by ARROW 4 in FIG. 1.
Figure 5:
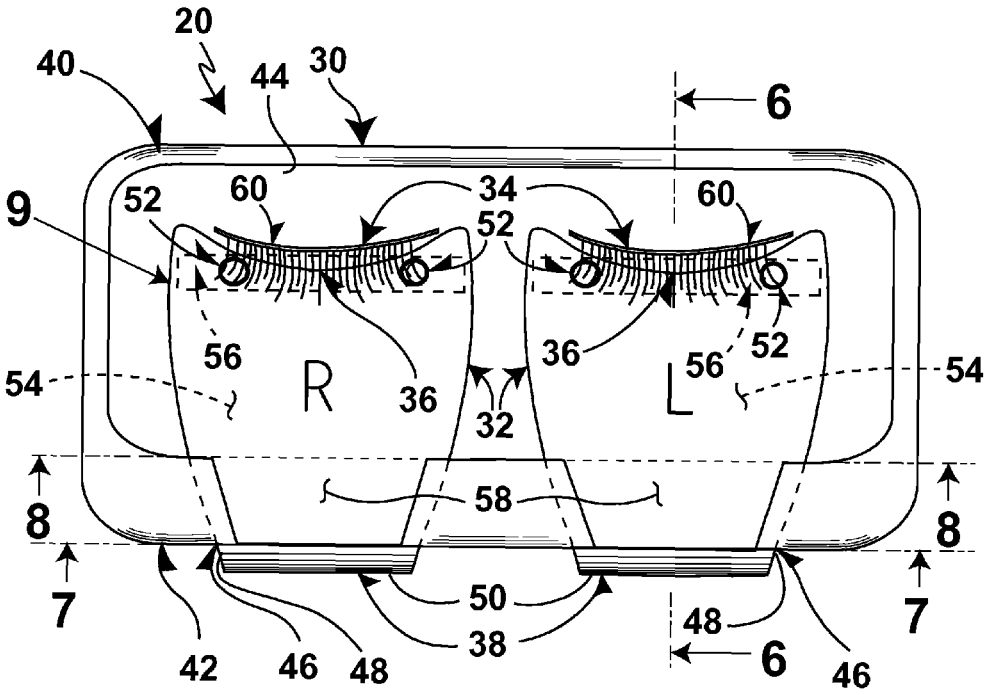
FIG. 5 is a diagrammatic top plan view of the integral cosmetic eye-enhancer and applier of the embodiments of the present invention taken generally in the direction of ARROW 5 in FIG. 4.
Figure 6:
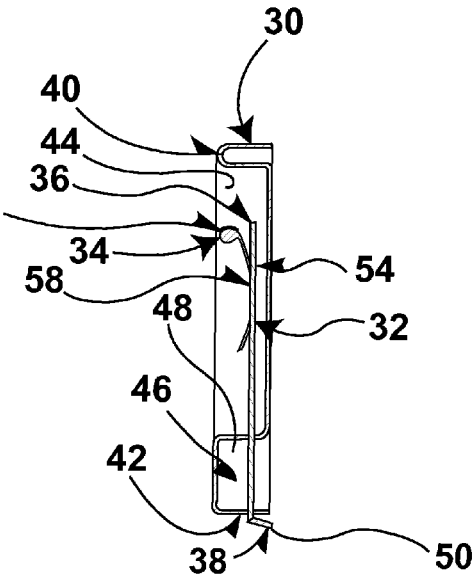
FIG. 6 is a diagrammatic cross sectional view taken along LINE 6-6 in FIG. 5.
Figure 7:
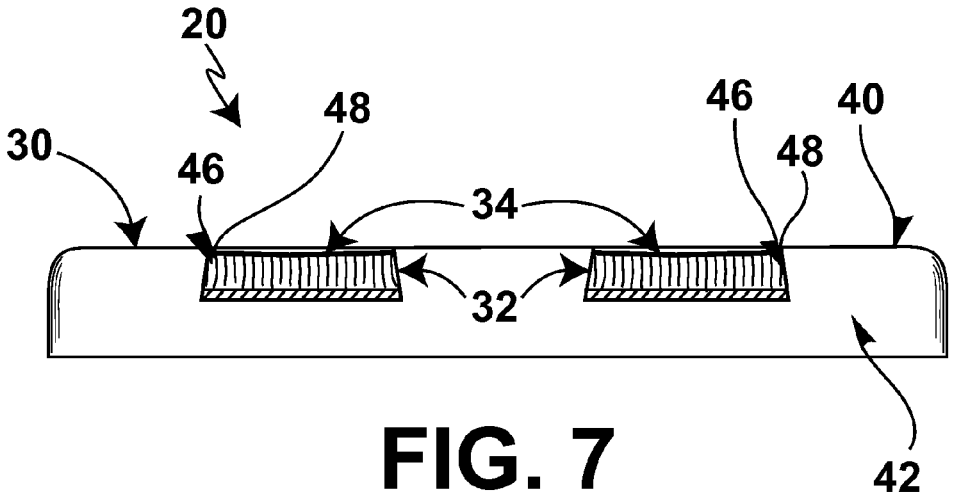
FIG. 7 is a diagrammatic front elevational view taken along LINE 7-7 in FIG. 5.
Figure 8:
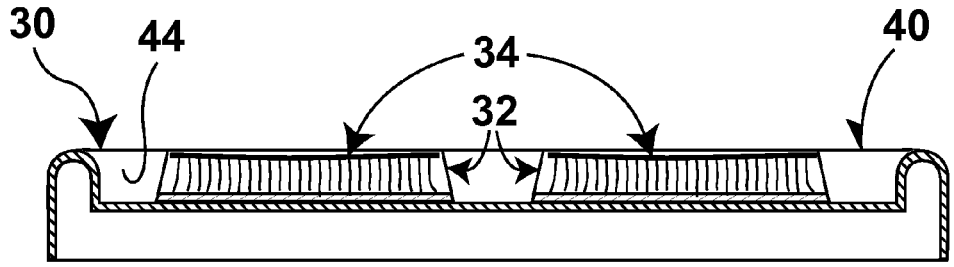
FIG. 8 is a diagrammatic cross sectional view taken along LINE 8-8 in FIG. 5.
Figure 9:
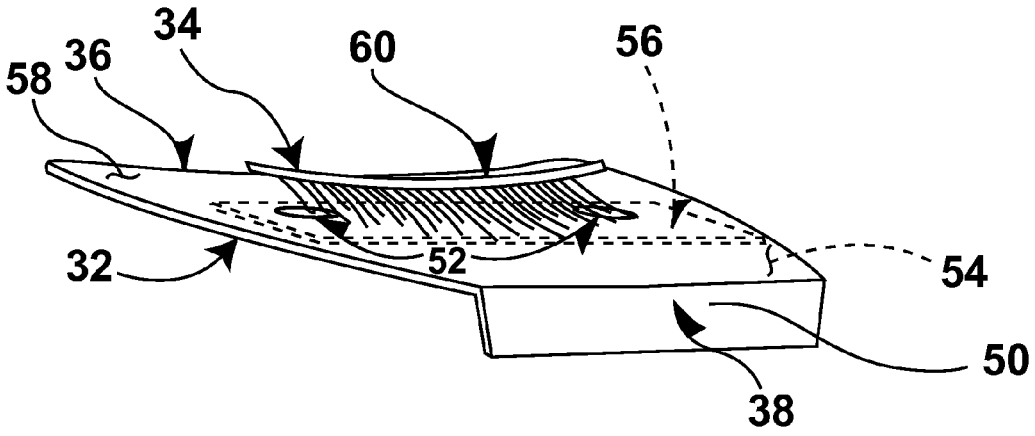
FIG. 9 is a diagrammatic perspective view of the integral cosmetic eye-enhancer and applier of the embodiments of the present invention identified by ARROW 9 in FIG. 5.
Figure 10:
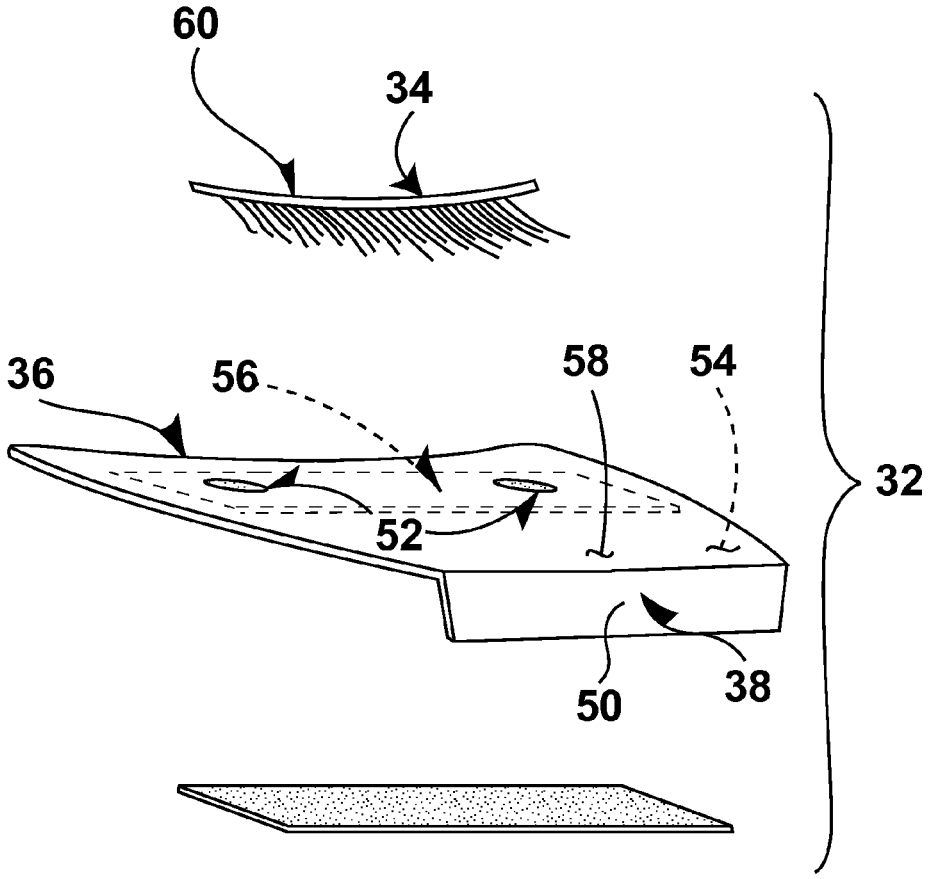
FIG. 10 is an exploded diagrammatic perspective view of the integral cosmetic eye-enhancer and applier of the embodiments of the present invention shown in FIG. 9.

The configuration of the integral cosmetic eye-enhancer and applier 20 can best be seen in FIGS. 4-10, which are, respectively, an enlarged diagrammatic perspective view of the integral cosmetic eye-enhancer and applier of the embodiments of the present invention identified by ARROW 4 in FIG. 1, a diagrammatic top plan view of the integral cosmetic eye-enhancer and applier of the embodiments of the present invention taken generally in the direction of ARROW 5 in FIG. 4, a diagrammatic cross sectional view taken along LINE 6-6 in FIG. 5, a diagrammatic front elevational view taken along LINE 7-7 in FIG. 5, a diagrammatic cross sectional view taken along LINE 8-8 in FIG. 5, a diagrammatic perspective view of the integral cosmetic eye-enhancer and applier of the embodiments of the present invention identified by ARROW 9 in FIG. 5, and an exploded diagrammatic perspective view of the integral cosmetic eye-enhancer and applier of the embodiments of the present invention shown in FIG. 9, and as such, will be discussed with reference thereto.

The integral cosmetic eye-enhancer and applier 20 comprises a storage container 30, a pair of applicator trays 32, and a pair of false eyelashes 34.

The pair of applicator trays 32 are replaceably contained within the storage container 30.

The pair of false eyelashes 34 are releasibly attached to corresponding working ends 36 of the pair of applicator trays 32, respectively, while the other corresponding ends 38 of the pair of applicator trays 32, respectively, are for holding by the fingertips 26 of the user 28 generally horizontally so as to have to bend the wrist of the user 28 but not have to squeeze the other corresponding ends 38 of the pair of applicator trays 32 by the fingertips 26 of the user 28 when donning the pair of false eyelashes 34 so as to facilitate donning of the pair of false eyelashes 34.

(1) Specific Configuration of the Storage Container 30.

The storage container 30 is generally rectangular-shaped, and has a top 40 and a front wall 42.

The top 40 of the storage container 30 has a recess 44 therein, and the front wall 42 of the storage container 30 has a pair of through openings 46 therethrough.

The pair of through openings 46 of the front wall 42 of the storage container 30 are spaced-apart from each other in a side-by-side relationship, and communicate with the recess 44 of the top 40 of the storage container 30.

The pair of through openings 46 of the front wall 42 of the storage container 30 are a pair of dovetailed mortises 48, respectively.

(2) Specific Configuration of the Pair of Applicator Trays 32 and the Pair of False Eyelashes 34.

The pair of applicator trays 32 sit replaceably in the recess 44 of the top 40 of the storage container 30, with the other corresponding ends 38 of the pair of applicator trays 32, respectively, extending outwardly through the pair of dovetailed mortises 48 of the pair of through openings 46 of the front wall 42 of the storage container 30, respectively.

The pair of applicator trays 32 have widths that prevent them from being lifted upwardly out of the pair of dovetailed mortises 48 of the pair of through openings 46 of the front wall 42 of the storage container 30, respectively, without having to be bent so as to prevent inadvertent removal of the pair of applicator trays 32 from the storage container 30 via the pair of dovetailed mortises 48 of the pair of through openings 46 of the front wall 42 of the storage container 30, respectively.

The pair of applicator trays 32 diverge from the other corresponding ends 38 of the pair of applicator trays 32, respectively, to the corresponding working ends 36 of the pair of applicator trays 32, respectively.

The corresponding working ends 36 of the pair of applicator trays 32, respectively, are arcuately concaved-shaped for matching that of the eyelids of the user 28 to thereby facilitate donning the pair of false eyelashes 34, and the other corresponding ends 38 of the pair of applicator trays 32, respectively, are a pair of generally normally bent down tabs 50, respectively, that generally rest against the front wall 42 of the storage container 30 and that prevent the pair of applicator trays 32 from sliding out of the storage container 30 in a direction opposite to that of the front wall 42 of the storage container 30.

The pair of applicator trays 32 have two pair of through bores 52 therethrough, respectively. The two pair of through bores 52 of the pair of applicator trays 32, respectively, are disposed in close proximity to the corresponding working ends 36 of the pair of applicator trays 32, respectively.

The pair of applicator trays 32 further have a pair of lowermost surfaces 54, respectively, a pair of tape strips 56, respectively, and a pair of uppermost surfaces 58, respectively. The pair of tape strips 56 of the pair of applicator trays 32, respectively, are adhered to the pair of lowermost surfaces 54 of the pair of applicator trays 32, respectively, and are disposed laterally beneath the two pair of through bores 52 of the pair of applicator trays 32, respectively, so as to allow adhesive from the pair of tape strips 56 of the pair of applicator trays 32, respectively, to be accessible from the pair of uppermost surface 58 of the pair of applicator trays 32, respectively, via the two pair of through bores 52 of the pair of applicator trays 32, respectively.

The pair of false eyelashes 34 are arcuately concaved-shaped to match that of, are releasibly affixed to, and are extend slightly outwardly from, the corresponding working ends 36 of the pair of applicator trays 32, respectively, via the adhesive from the pair of tape strips 56 of the pair of applicator trays 32, respectively, that is accessible via the two pair of through bores 52 of the pair of applicator trays 32, respectively.

The pair of false eyelashes 34 have an affixing apparatus 60. The affixing apparatus 60 of the pair of false eyelashes 34 is for releasibly affixing the pair of false eyelashes 34 to the eyelashes of the user 28.

(a) Specific Configuration of a First Embodiment of the Affixing Apparatus 160.

The specific configuration of the affixing apparatus 160 can best be seen in FIGS. 11 and 13, which are, respectively, a diagrammatic perspective view of a first embodiment of an affixing apparatus of the integral cosmetic eye-enhancer and applier of the embodiments of the present invention, and an enlarged diagrammatic cross sectional view taken along LINE 13-13 in FIG. 11 of the affixing apparatus embodiment shown in FIG. 11 but in a storage container of the integral cosmetic eye-enhancer and applier of the embodiments of the present invention, and as such, will be discussed with reference thereto.

The affixing apparatus 160 includes adhesives 162 and release sheets 164. The adhesives 162 of the affixing apparatus 160 extend along the pair of false eyelashes 34, respectively, and are protected prior to use by the release sheets 164 of the affixing apparatus 160, respectively.

(b) Specific Configuration of a Second Embodiment of the Affixing Apparatus 260.

The specific configuration of the affixing apparatus 260 can best be seen in FIGS. 12 and 14, which are, respectively, a diagrammatic perspective view of a second embodiment of an affixing apparatus of the integral cosmetic eye-enhancer and applier of the embodiments of the present invention, and an enlarged diagrammatic cross sectional view taken along LINE 14-14 in FIG. 12 of the affixing apparatus embodiment shown in FIG. 12 but in a storage container of the integral cosmetic eye-enhancer and applier of the embodiments of the present invention, and as such, will be discussed with reference thereto.

The affixing apparatus 260 includes adhesives 262. The adhesives 262 of the affixing apparatus 260 are applied along the pair of false eyelashes 34, respectively, and are, preferably provided by a tube 264.

C. Impressions.

It will be understood that each of the elements described above or two or more together may also find a useful application in other types of constructions differing from the types described above.

While the embodiments of the present invention have been illustrated and described as embodied in an integral cosmetic eye-enhancer and applier for facilitating donning of the cosmetic eye-enhancer by holding the applier by the fingertips of a user generally horizontally so as to have to bend the wrist of the user but not have to squeeze the applier by the fingertips of the user when donning the cosmetic eye-enhancer, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An integral cosmetic eye-enhancer and applier for facilitating donning of said cosmetic eye-enhancer by holding said applier by the fingertips of a user generally horizontally so as to have to bend the wrist of the user but not have to squeeze said applier by the fingertips of the user when donning said cosmetic eye-enhancer, comprising:

a) a storage container;

b) a pair of applicator trays; and c) a pair of false eyelashes;

wherein said pair of applicator trays are replaceably contained within said storage container;

wherein said pair of false eyelashes are releasibly attached to corresponding working ends of said pair of applicator trays, respectively; and wherein the other corresponding ends of said pair of applicator trays are for holding by the fingertips of the user generally horizontally so as to have to bend the wrist of the user but not have to squeeze said other corresponding ends of said pair of applicator trays by the fingertips of the user when donning said pair of false eyelashes so as to facilitate donning of said pair of false eyelashes;

wherein said storage container has a top; and wherein said top of said storage container has a recess therein;

wherein said storage container has a front wall;

wherein said front wall of said storage container has a pair of through openings therethrough;

wherein said other corresponding ends of said pair of applicator trays, respectively, are a pair of generally normally bent down tabs, respectively; and wherein said pair of generally normally bent down tabs of said other corresponding ends of said pair of applicator trays, respectively, generally rest against said front wall of said storage container to prevent said pair of applicator trays from sliding out of said storage container in a direction opposite to that of said front wall of said storage container.

2. The integral cosmetic eye-enhancer and applier of claim 1, wherein said storage container is generally rectangular-shaped.

3. The integral cosmetic eye-enhancer and applier of claim 1, wherein said pair of through openings of said front wall of said storage container are spaced-apart from each other in a side-by-side relationship; and wherein said pair of through openings of said front wall of said storage container communicate with said recess of said top of said storage container.

4. The integral cosmetic eye-enhancer and applier of claim 1, wherein said pair of through openings of said front wall of said storage container are a pair of dovetailed mortises, respectively.

5. The integral cosmetic eye-enhancer and applier of claim 4, wherein said pair of applicator trays sit replaceably in said recess of said top of said storage container, with said other corresponding ends of said pair of applicator trays, respectively, extending outwardly through said pair of dovetailed mortises of said pair of through openings of said front wall of said storage container, respectively.

6. The integral cosmetic eye-enhancer and applier of claim 4, wherein said pair of applicator trays have widths that prevent them from being lifted upwardly out of said pair of dovetailed mortises of said pair of through openings of said front wall of said storage container, respectively, without having to be bent so as to prevent inadvertent removal of said pair of applicator trays from said storage container via said pair of dovetailed mortises of said pair of through openings of said front wall of said storage container, respectively.

7. The integral cosmetic eye-enhancer and applier of claim 1, wherein said pair of applicator trays diverge from said other corresponding ends of said pair of applicator trays, respectively, to said corresponding working ends of said pair of applicator trays, respectively.

8. The integral cosmetic eye-enhancer and applier of claim 1, wherein said corresponding working ends of said pair of applicator trays, respectively, are arcuately concaved-shaped for matching that of the eyelids of the user to thereby facilitate donning said pair of false eyelashes.

9. The integral cosmetic eye-enhancer and applier of claim 1, wherein said pair of applicator trays have two pair of through bores therethrough, respectively.

10. The integral cosmetic eye-enhancer and applier of claim 9, wherein said two pair of through bores of said pair of applicator trays, respectively, are disposed in close proximity to said corresponding working ends of said pair of applicator trays, respectively.

11. The integral cosmetic eye-enhancer and applier of claim 9, wherein said pair of applicator trays have:

a) a pair of lowermost surfaces, respectively;

b) pair of tape strips, respectively; and c) a pair of uppermost surfaces, respectively.

12. The integral cosmetic eye-enhancer and applier of claim 11, wherein said pair of tape strips of said pair of applicator trays, respectively, are adhered to said pair of lowermost surfaces of said pair of applicator trays, respectively; and wherein said pair of tape strips of said pair of applicator trays, respectively, are disposed laterally beneath said two pair of through bores of said pair of applicator trays, respectively, so as to allow adhesive from said pair of tape strips of said pair of applicator trays, respectively, to be accessible from said pair of uppermost surfaces of said pair of applicator trays, respectively, via said two pair of through bores of said pair of applicator trays, respectively.

13. The integral cosmetic eye-enhancer and applier of claim 11, wherein said pair of false eyelashes are arcuately concaved-shaped to match that of, are releasibly affixed to, and extend slightly outwardly from, said corresponding working ends of said pair of applicator trays, respectively, via said adhesive from said pair of tape strips of said pair of applicator trays, respectively, that is accessible via said two pair of through bores of said pair of applicator trays, respectively.

14. The integral cosmetic eye-enhancer and applier of claim 1, wherein said pair of false eyelashes have affixing means for releasibly affixing said pair of false eyelashes to the eyelashes of the user.

15. The integral cosmetic eye-enhancer and applier of claim 14, wherein said affixing means includes:

a) adhesives; and b) release sheets.

16. The integral cosmetic eye-enhancer and applier of claim 15, wherein said adhesives of said affixing means extend along said pair of false eyelashes, respectively, and are protected prior to use by said release sheets of said affixing means, respectively.

17. The integral cosmetic eye-enhancer and applier of claim 14, wherein said affixing means includes adhesives.

18. The integral cosmetic eye-enhancer and applier of claim 17, wherein said adhesives of said affixing means are applied along said pair of false eyelashes, respectively.

19. The integral cosmetic eye-enhancer and applier of claim 17, wherein said adhesives of said affixing means are provided by a tube.

* * * * *